US011095994B2

(12) United States Patent
Andersson et al.

(10) Patent No.: US 11,095,994 B2
(45) Date of Patent: Aug. 17, 2021

(54) CONFORMABLE PAD BONE CONDUCTION DEVICE

(71) Applicant: Cochlear Limited, Macquarie University (AU)

(72) Inventors: Marcus Andersson, Gothenburg (SE); Goran Bjorn, Onsala (SE); Stefan Magnander, Gothenburg (SE); Henrik Fyrlund, Molnlycke (SE); Koen van den Heuvel, Hove (BE); Tobias Good, Molnlycke (SE)

(73) Assignee: Cochlear Limited, Macquarie University (AU)

( * ) Notice: Subject to any disclaimer, the term of this patent is extended or adjusted under 35 U.S.C. 154(b) by 2161 days.

(21) Appl. No.: 13/768,206

(22) Filed: Feb. 15, 2013

(65) Prior Publication Data

US 2014/0233765 A1 Aug. 21, 2014

(51) Int. Cl.
*H04R 25/00* (2006.01)

(52) U.S. Cl.
CPC ..... *H04R 25/606* (2013.01); *H04R 2460/13* (2013.01)

(58) Field of Classification Search
CPC ..... H04R 2460/13; H04R 11/00; H04R 1/14; H04R 1/46; H04R 25/606
USPC ..... 381/151
See application file for complete search history.

(56) References Cited

U.S. PATENT DOCUMENTS 2,470,933 A * 5/1949 Knowles ..... H04R 25/606 381/151
2,756,016 A * 7/1956 Painter ..... F16F 5/00 267/118
2,859,033 A * 11/1958 Rose ..... F16C 27/066 267/153
3,350,344 A * 10/1967 Beers ..... C08G 77/56 273/DIG. 29
3,382,511 A * 5/1968 Brooks ..... A47C 7/18 5/652
3,881,570 A * 5/1975 Lewis ..... A61F 11/08 128/864
4,195,151 A * 3/1980 Dunleavy ..... C08G 18/544 252/182.26

(Continued)

FOREIGN PATENT DOCUMENTS

CN 1454443 A 11/2003
CN 1976541 A 6/2007

(Continued)

OTHER PUBLICATIONS

International Search Report for International Application No. PCT/IB2014/058927, dated Jun. 19, 2014.

(Continued)

*Primary Examiner* — Oyesola C Ojo

(74) *Attorney, Agent, or Firm* — Pilloff Passino & Cosenza LLP; Martin L Cosenza

(57) ABSTRACT

Pads for positioning between external hearing prosthesis components and a recipient's skin or scalp that conform to the recipient's anatomy but transmit vibrations from the external components to implanted components. Usable pad materials may include non-Newtonian materials including dilatant materials, rheological materials, memory foams, viscoelastic material, thermoplastics, electro-rheological fluids and or magneto-rheological fluids.

43 Claims, 5 Drawing Sheets

(56) References Cited

U.S. PATENT DOCUMENTS 4,298,383 A * 11/1981 Joyce ..... B22F 3/001 419/36
5,483,027 A * 1/1996 Krause ..... A61F 11/10 128/865
5,573,088 A * 11/1996 Daniels ..... B60G 17/0157 188/267
6,456,721 B1 * 9/2002 Fukuda ..... H04R 1/1066 381/151
6,701,529 B1 * 3/2004 Rhoades ..... C08L 83/16 2/2.5
7,176,419 B2 * 2/2007 Ellis ..... A61F 7/007 219/212
7,386,143 B2 * 6/2008 Easter ..... H04R 25/606 381/312
7,966,937 B1 * 6/2011 Jackson ..... F42B 12/74 102/501
8,107,648 B2 * 1/2012 Nakatani ..... H04R 1/1075 381/151
8,376,967 B2 * 2/2013 Mersky ..... A61B 5/11 381/151
8,795,172 B2 * 8/2014 Abolfathi ..... A61B 5/0002 600/301
8,891,795 B2 11/2014 Andersson
9,022,917 B2 * 5/2015 Kasic ..... H04R 25/606 600/25
9,031,274 B2 * 5/2015 Kasic, II ..... H04R 25/60 381/151
9,526,810 B2 * 12/2016 Ruppersberg ..... H04R 25/606
9,736,601 B2 * 8/2017 Kasic ..... H04R 25/606
2002/0094439 A1 * 7/2002 Edelmann ..... C08K 9/06 428/404
2002/0183014 A1 * 12/2002 Takeda ..... H04R 1/14 455/73
2004/0171321 A1 * 9/2004 Plant ..... A41D 31/005 442/64
2005/0201574 A1 * 9/2005 Lenhardt ..... A61H 23/0245 381/151
2006/0089721 A1 * 4/2006 Muhanna ..... A61F 2/442 623/17.16
2007/0053536 A1 * 3/2007 Westerkull ..... H04R 25/606 381/326
2007/0179864 A1 * 8/2007 Leeds ..... A47C 7/021 705/14.27
2008/0205679 A1 8/2008 Darbut et al.
2009/0017709 A1 * 1/2009 Fliedner ..... C08L 61/06 442/121
2009/0192345 A1 7/2009 Westerkull et al.
2009/0248155 A1 10/2009 Parker
2009/0304209 A1 12/2009 Nakatani
2009/0308401 A1 * 12/2009 Orrico ..... A61F 5/566 128/848
2011/0106254 A1 * 5/2011 Abel ..... A61F 2/18 623/16.11
2011/0158920 A1 * 6/2011 Morley ..... A61P 17/04 424/59
2012/0080039 A1 4/2012 Siegert
2012/0232616 A1 9/2012 Van Baelen et al.
2012/0253105 A1 * 10/2012 Mayer ..... H04R 25/606 600/25
2012/0294466 A1 * 11/2012 Kristo ..... H04R 25/606 381/322
2012/0302822 A1 * 11/2012 Van Himbeeck .... H04R 25/606 600/25
2012/0302823 A1 11/2012 Andersson et al.
2013/0046346 A1 * 2/2013 Thorwarth ..... A61F 2/02 606/281
2013/0169513 A1 * 7/2013 Heinrich ..... G06F 1/163 345/8
2013/0281764 A1 10/2013 Bjorn et al.
2014/0064533 A1 3/2014 Kasic, II
2014/0121451 A1 * 5/2014 Kasic ..... H04R 25/606 600/25
2014/0336447 A1 11/2014 Björn et al.
2015/0038775 A1 2/2015 Ruppersberg

FOREIGN PATENT DOCUMENTS

CN 101268717 A 9/2008
CN 101315769 * 12/2008 ..... G10K 11/18
CN 101315769 A 12/2008
DE 19541882 A1 5/1997
DE 202004006117 U1 7/2004
JP 2001029509 A 2/2001
JP 2002359889 A 12/2002
JP 2003322612 A 11/2003
JP 2005-094110 A 4/2005
JP 2005-328125 A 11/2005
JP 2006197257 A * 7/2006 ..... H04R 1/00
JP 2008177705 A 7/2008
JP 2010144021 A * 7/2010 ..... C08L 83/04
JP 2011087142 A 4/2011
JP 2011160175 A 8/2011
KR 101091847 B1 * 12/2011 ..... A45D 44/22
WO 2004/030572 A2 4/2004
WO WO-2012028845 * 3/2012 ..... G01H 9/00

OTHER PUBLICATIONS

Stefan Stenfelt et al., "Transmission properties of bone conducted sound: Measurements in cadaver heads," Journal of the Acoustical Society of America, Oct. 2005, 2373-2391, vol. 118, No. 4.
B. Håkansson et al., "Hearing Thresholds with Direct Bone Conduction Versus Conventional Bone Conduction," Scandinavian Audiology, Jan. 1, 1984, 3-13, vol. 13, No. 1.
Extended European Search Report for EP14751228.9, dated Mar. 29, 2016.
Office Action for Japan Application No. 2015-557545, dated Oct. 13, 2017.
Office Action for Japan Application No. 2015-557545, dated Aug. 28, 2018.
Office Action for China Application No. 201480003216.1, dated Oct. 9, 2018.

* cited by examiner

CONFORMABLE PAD BONE CONDUCTION DEVICE

BACKGROUND

Field of the Technology

This disclosure relates generally to bone conduction devices, and more particularly, to transcutaneous bone conduction devices.

Related Art

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants include an electrode array for implantation in the cochlea to deliver electrical stimuli to the auditory nerve, thereby causing a hearing percept.

Conductive hearing loss occurs when the normal mechanical pathways that provide sound to hair cells in the cochlea are impeded, for example, by damage to the ossicular chain or ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses a component positioned at the recipient's auricle or ear canal which amplifies received sound. This amplified sound reaches the cochlea causing stimulation of the auditory nerve.

In contrast to hearing aids, certain types of hearing prostheses commonly referred to as bone conduction devices convert a received sound into mechanical vibrations. The vibrations are transferred through the skull or jawbone to the cochlea causing generation of nerve impulses, which result in the perception of the received sound. Bone conduction devices may be a suitable alternative for individuals who cannot derive sufficient benefit from acoustic hearing aids, cochlear implants, etc.

Coupling bone conduction devices to the cranium or jawbone in ways that remain functional and comfortable for the recipient is challenging because of the nature and location of forces that must be utilized and successfully managed.

SUMMARY

The terms "invention," "the invention," "this invention," "the present invention," "disclosure," "the disclosure," "this disclosure" and "the present disclosure" used in this patent are intended to refer broadly to all of the subject matter of this patent and the patent claims below. Statements containing these terms should be understood not to limit the subject matter described herein or to limit the meaning or scope of the patent claims below. Aspects and embodiments of the invention(s) covered by this patent are defined by the claims below, not this summary. This summary is a high-level overview of various aspects and embodiments of the invention(s) and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In accordance with one aspect of this disclosure an implantable component of a prosthesis, comprising a bone fixture and one or more magnets or magnetic components disposed in a housing coupled to a bone fixture, such as an osseointegrating screw implant, is implanted in a recipient so that there is no structure penetrating the skin following post-implantation healing. An external component comprising a sound processor and a vibrator is magnetically coupled to the implanted component by means of a pressure plate. Magnets or magnetic components are disposed in the external component or pressure plate are attracted to magnets or magnetic components in the implanted component. This magnetic attraction draws the pressure plate into contact with, and thereby applies force to, the recipient's skin.

Alternatively the pressure plate may be held in contact with the recipient's skin by a headband encircling the recipient's head or any other appropriate means for maintaining the pressure plate in its proper location.

A pad, layer or other appropriate structure between the pressure plate and the recipient's skin that transfers force to the skin evenly while also appropriately transmitting vibrations avoids higher pressure contact points or regions to enhance recipient comfort and reduce the likelihood and incidence of pressure wounds or skin necrosis due to pressure. Such a material generally needs the capacity to conform very accurately to the "topography" of the recipient's skin in contact with the pressure plate. It is generally acceptable for such conformation to occur over a relatively significant period of time or to require a one-time process for fitting the pressure plate to the recipient. Materials suitable for use in implementing embodiments of this invention need to have some ability to transmit audio-frequency vibrations so that the hearing prosthesis can function successfully. Materials suitable for such a pad between the recipient's skin and the external component also need to facilitate securing the external component in place during a normal range of recipient activities. The materials used for the pad provide controllably variable balance of pressure equalization and vibration transmission capability. The materials can be controlled to provide balance of pressure equalization and vibration transmission capability.

Such a pressure-equalizing layer or pad may be: (a) a layer or layers of non-Newtonian material like dilatant material, rheopectic or slow-recovery memory foam (b) a layer of plastic material (such as a thermoplastic like polyvinyl chloride or polylactic acid) for positioning between the vibrating unit and the recipient's scalp that is softened and, while still soft, conformed to the shape of the wearer's scalp overlying the implanted prosthesis and then solidified or permitted to solidify for use between the scalp and the vibrating unit, (c) other viscoelastic materials (d) or other materials having adjustable apparent viscosity.

In accordance with another aspect of the present disclosure a method comprising the steps of: causing the viscosity of a material to decrease thereby enabling a pad containing the material to conform to the topographies of a recipient's head and causing the viscosity of the material to increase thereby enabling the pad to effectively transfer sound vibrations to the recipient's head.

BRIEF DESCRIPTION OF THE DRAWINGS

Embodiments of the present disclosure are described below with reference to the attached drawings, in which.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Aspects of the present disclosure are generally directed to a transcutaneous bone conduction device configured to deliver mechanical vibrations generated by an external vibrator to a recipient's cochlea via the skull to cause a hearing percept. The bone conduction device includes an implantable bone fixture adapted to be secured to the skull, and one or more magnets disposed in a housing coupled to the bone fixture. When implanted, the one or more magnets are capable of forming a magnetic coupling with the external vibrator sufficient to permit effective transfer of the mechanical vibrations to the implanted magnets, which are then transferred to the skull via the bone fixture.

Figure 1:
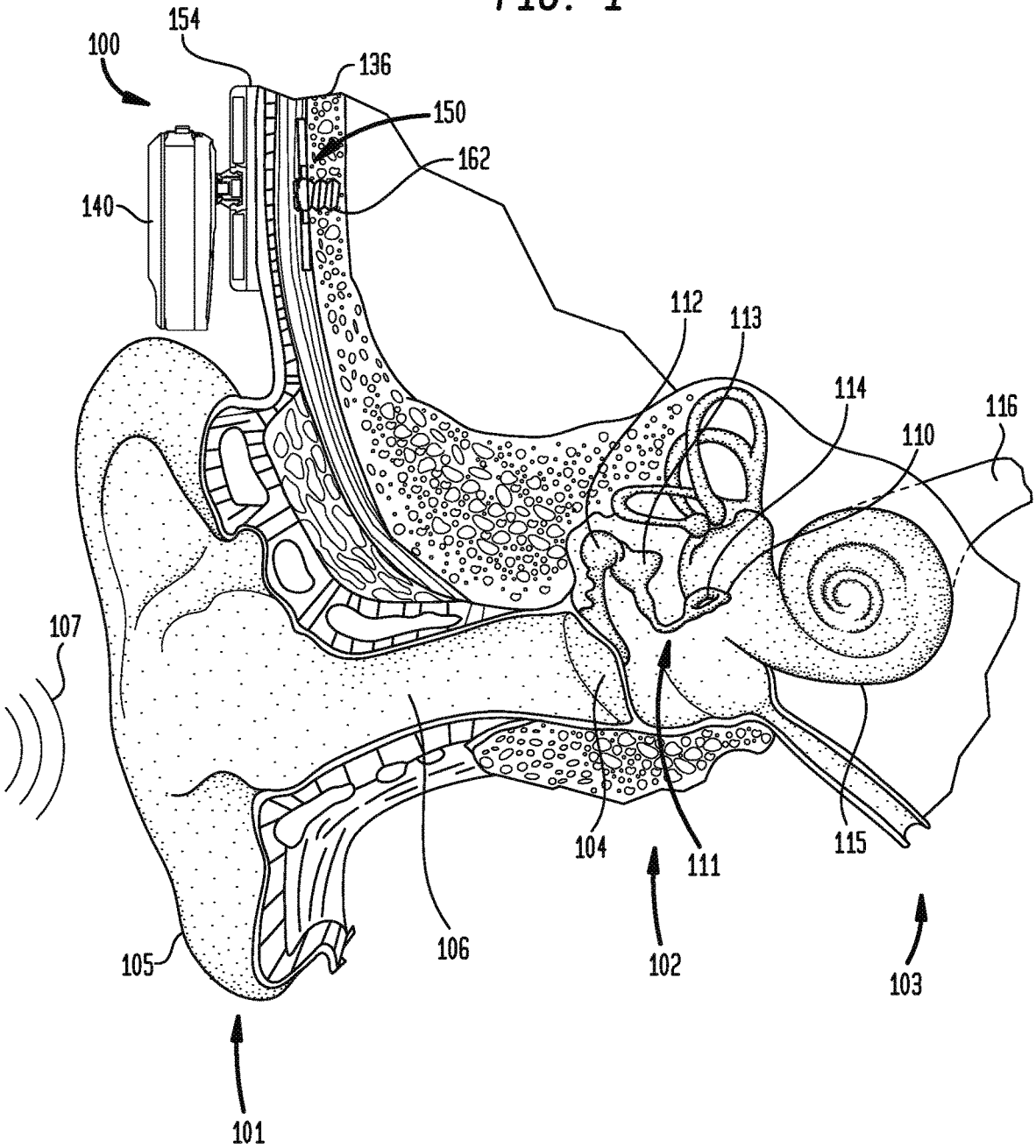
FIG. 1 is a perspective view of an exemplary bone conduction device in which embodiments of the present disclosure may be implemented.

FIG. 1 is a perspective view of a transcutaneous bone conduction device 100 in which embodiments of the present disclosure may be implemented. As shown, the recipient has an outer ear 101, a middle ear 102 and an inner ear 103. In a fully functional human hearing anatomy, outer ear 101 comprises an auricle 105 and an ear canal 106. Sound waves 107 is collected by auricle 105 and channeled into ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Ossicles 111 serve to filter and amplify acoustic wave 107, causing oval window 110 to vibrate. Such vibration sets up waves of fluid motion within cochlea 115 which, in turn, activates hair cells lining the inside of the cochlea. Activation of the hair cells causes appropriate nerve impulses to be transferred through the spiral ganglion cells and auditory nerve 116 to the brain, where they are perceived as sound.

FIG. 1 also illustrates the positioning of bone conduction device 100 on the recipient. As shown, bone conduction device 100 is secured to the skull behind outer ear 101. Bone conduction device 100 comprises an external component 140 that includes a sound input element (not shown) to receive sound signals. The sound input element may comprise, for example, a microphone, telecoil, etc. In an exemplary embodiment, the sound input element may be located, for example, on or in external component 140 or on a cable or tube extending from external component 140. Alternatively, the sound input element may be subcutaneously implanted in the recipient, or positioned in the recipient's ear. The sound input element may also be a component that receives an electronic signal indicative of sound, such as, for example, from an external audio device.

External component 140 also comprises a sound processor (not shown), an actuator (also not shown) and/or various other functional components, including a pressure plate 146. In operation, the sound input device converts received sound into electrical signals. These electrical signals are processed by the sound processor to generate control signals that cause pressure plate 146 to vibrate and deliver mechanical vibrations to internal or implantable component 150.

A pad 154 further described below is positioned in contact with the recipient's skin 132 between the skin 132 and pressure plate 146.

Internal or implantable component 150 comprises a bone fixture 162 such as a bone screw to secure an implantable magnetic component 152 to skull bone 136. Typically, bone fixture 162 is configured to osseointegrate into skull bone 136. Magnetic component 152 forms a magnetic coupling with magnets 156 in external component 140 sufficient to permit effective transcutaneous transfer of the mechanical vibrations to internal component 150, which are then transferred to skull bone 136. Alternatively, the vibrations from external component 140 may be transcutaneously transferred to implantable component 150 via the magnetic coupling.

In the embodiments described herein, external component 150 includes a pressure plate 146 that may conform to the curvature of the recipient's skull. In such embodiments, vibrations produced by the vibrating actuator are transferred from plate 146 across the skin to implantable component 150. It should be appreciated, however, that external component 140 may take on a variety of configurations some of which do not include a pressure plate as illustrated in FIG. 1. For example, the housing of the vibrator actuator directly contacts the recipient in some embodiments, while in other embodiments external component 140 is disposed in a Behind-The-Ear (BTE) device that directly contacts the recipient's head. In these and other bone conduction devices, the portion of external component 140 that contacts the recipient for transcutaneous transfer of vibrations such as pressure plate 146, a portion of an actuator housing or a portion of a BTE housing, is referred to herein as a pressure plate.

Because the anatomy and scalp shape vary from one recipient to another, no single plate has a contour or shape that will closely conform to every recipient. Moreover, in order to achieve sufficient retention of external component 140 to efficiently transfer sound vibrations, adequate magnetic attraction is needed between the implantable component 150 and the external component 140. Alternatively, other means such as a headband may be used to apply adequate force to hold external component 140 in its proper position. The attraction needed in a particular situation depends, among other things, on the weight of external component 140 and the motion of the recipient. The pressure that is exerted on the recipient's skin is a result of the skin contacting area of plate 146 and the force of attraction between the internal and external components. Excessive pressure (either localized or across the contacting surfaces) may cause soft tissue damage. Typically, for example a pressure of approximately 0.7 $N/cm^2$ is enough to cause damage to the soft tissue. In extreme cases, the soft tissue necrotizes and needs to heal before device 100 can be used again.

The exemplary transcutaneous bone conduction device illustrated in FIG. 1 has all active components, such as the actuator, located in external component 140. As such, the device illustrated in FIG. 1 is commonly referred to as a passive transcutaneous bone conduction device.

As is apparent from the description above, operation of passive transcutaneous bone conduction device 100 requires accommodation of two somewhat contradictory objectives. First external component 140 needs to be secured in place in contact with the recipient's scalp so that it does not slip out of position, and so that vibrations from external component 140 are effectively transmitted to internal or implantable component 150. Certain embodiments of pad 154, therefore, provide a balance of pressure-equalizing and vibration-transmission capacities.

Figure 2:
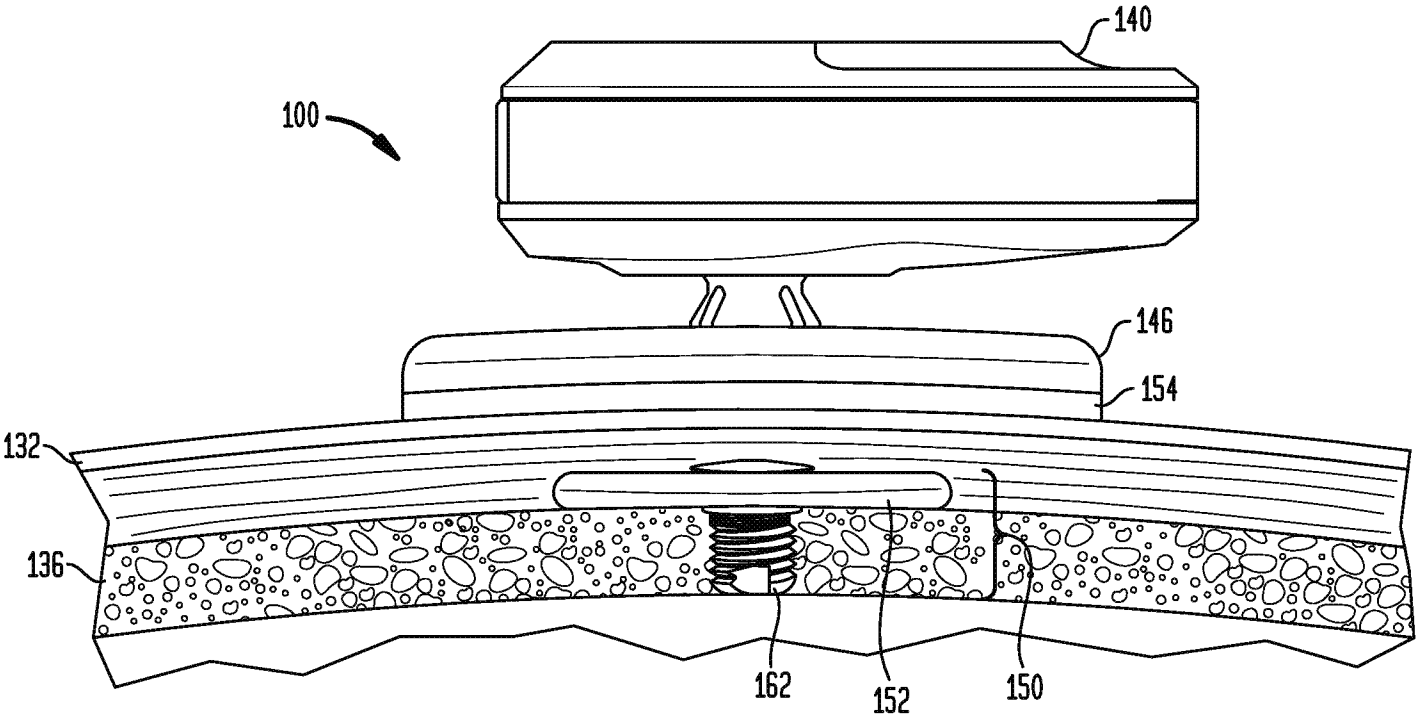
FIG. 2 is an enlarged side view, partially in section, showing the exemplary bone conduction device of FIG. 1.
Figure 3:
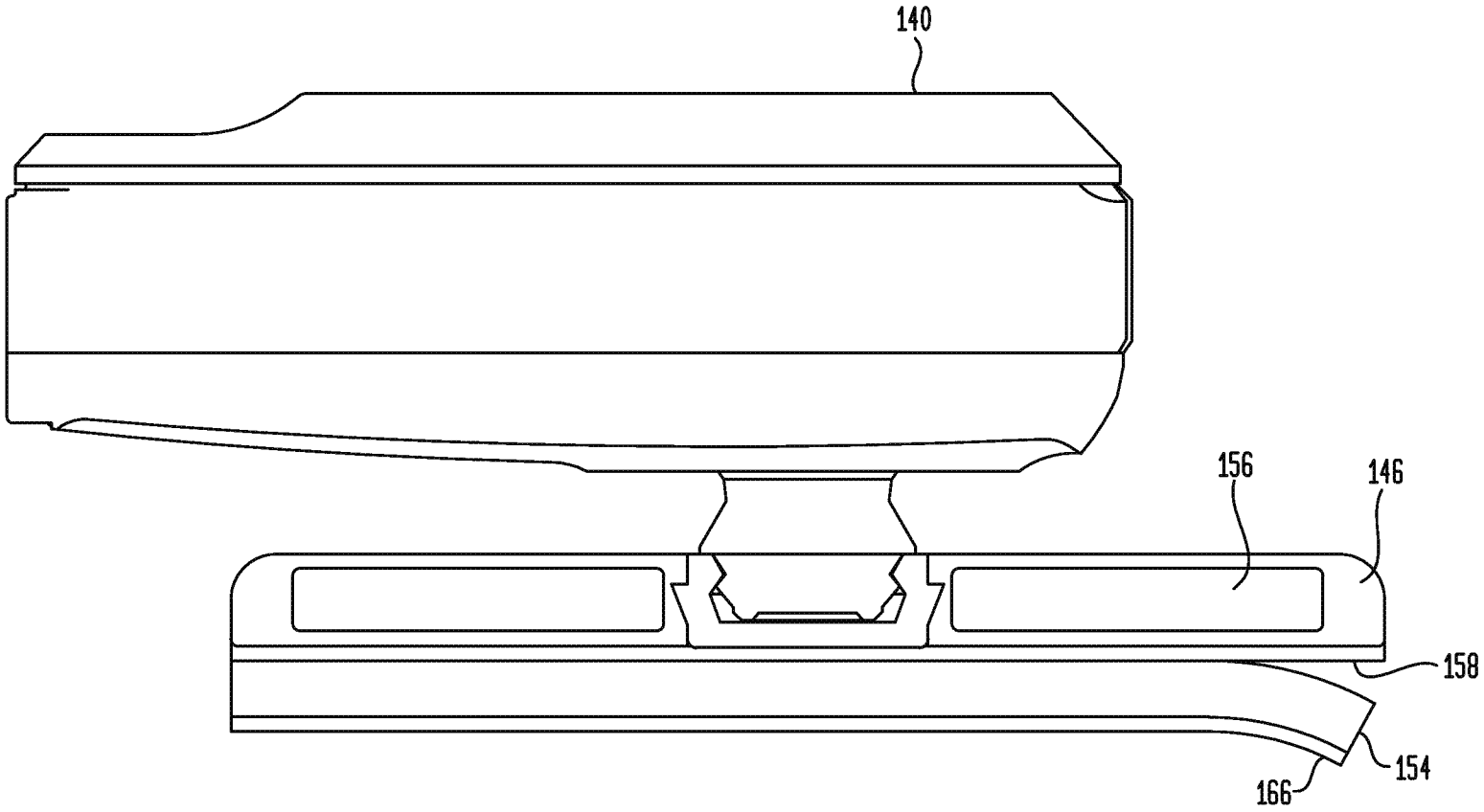
FIG. 3 is a further enlarged side view of the external portion of bone conduction device of FIG. 1.

FIGS. 2 and 3 depict an exemplary embodiment of transcutaneous bone conduction device 100 including embodiments of pad 154. Preferably, pad 154 distributes the forces exerted by pressure plate 146 substantially evenly across the entire area of contact to enhance recipient comfort and reduce the likelihood of damage to or development of sores in the recipient's skin 132. Pad 154 also transmits mechanical vibrations of pressure plate 146 to skin 132 so that vibrations are induced in a vibratory portion of implantable component 150.

Conventional soft or easily deformed materials in a pad typically would facilitate even distribution of forces exerted by a pressure plate 146; however, more rigid conventional materials typically better transmit vibrations. Embodiments of pad 154 provide both (a) conformation and low pressure characteristics; and (b) efficient vibration transmission if the material(s) forming all or a portion of pad 154 are non-Newtonian material(s). Non-Newtonian materials are advantageous because they provide a controllably variable balance of pressure equalization and sound transmission capacity. Non-Newtonian materials include, for example, Dilatant material, Rheopectic materials, and Slow recovery memory foam materials. Each of these exemplary materials is described below.

Dilatant material. Application of shear strain to these types of materials causes the viscosity to increase. In other words, these materials get harder when you apply force to them. An example of a dilatant material is an organosilicon made from silicone oil and boric acid.

Rheopectic materials. These materials are closely similar to dilatants. However, rheopectic materials develop higher viscosity (or get harder) when they are shaken. When shaking of these materials stops, hardness drops. Examples of rheopectic fluids include gypsum pastes and printers inks Polymeric rheopectic materials include some urethane materials.

Slow recovery memory foam materials, including, for example, polyurethane memory foams. Viscoelastic properties make memory foams effective in distributing pressure. There are basically two types of slow recovery memory foams. Low density memory foams are pressure sensitive, while high density memory foams are heat sensitive. Viscoelastic memory foams with a variety of different density, tensile strength, elongation, porosity and other properties are available and can be used in practicing various embodiments of the disclosed technology.

Figure 6:
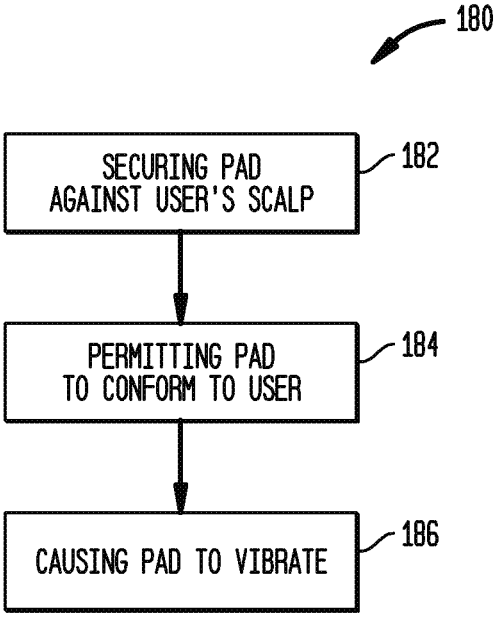
FIG. 6 is a flow diagram showing an embodiment of a method for transmitting sound vibrations between a transcutaneous bone conduction system transmitter and a bone conduction fixture implanted in a recipient.

All of these materials conform slowly to improve and equalize pressure distribution while exhibiting sufficient stiffness or apparent viscosity in use to achieve efficient sound or vibration transmission from external component 140 to internal component 150. These materials are sufficiently soft as to substantially conform to the topologies of at least a portion of the recipient's scalp or head, and to substantially equalize pressure distribution while also stiffening in response to certain external stimulus such as, for example, vibrations. In one example, the material used for the pad sufficiently stiffens in the presence of mechanical vibrations to achieve efficient vibration transmission from external component 140 to internal components 150. Embodiments of the materials used to form pad 154 exert a force between approximately 0.4 N to approximately 2.5 N, via pressure plate 146, to ensure adequate retention of external component 140 on the recipient as well as to provide adequate vibration transfer to internal component 150. The materials used to the form pad 154 do not exert a pressure greater than 0.9 $N/cm^2$ on the recipient's skin to prevent damage of the soft tissue. More typically the pressure is no more than approximately 0.5 $N/cm^2$. Embodiments of pad 154 facilitate a method 180 of positioning bone conduction prosthesis 100, as illustrated in FIG. 6, in which a first step 182 involves securing pad 154 in contact with the recipient's skin, a second step 184 involves permitting pad 154 to conform to the recipient's anatomy and a third step 186 involves causing implantable component 150 to vibrate.

Dilatant or rheopectic materials usable in alternative embodiments may be sufficiently viscous to substantially conform to a recipient's scalp or head shape. In the presence of a shear force or shaking, the viscosity of the material changes sufficiently to result in the material behaving as solids. This increases the effectiveness of the materials to transfer vibrations. Such materials, therefore, may be contained in a cover, container, bladder, film, bubble, skin or other structure 157 as illustrated in FIG. 5.

In other embodiments, pad 154 may be made of one or more plastic materials such as a thermoplastic. Exemplary thermoplastic materials include, for example, polyvinyl chloride and polylactic acid. Polylactic acid or polylactide is a thermoplastic aliphatic polyester.

Initially, or possibly before each use, the plastic material(s) of such a thermoplastic pad 154 may be softened by the application of heat. For instance, pad 154 may be immersed in hot water, or the pad may be heated via convection or conduction. Pad 154 might then be held in position against the recipient's scalp 132 and permitted to cool and at least partially solidify while maintaining a shape that conforms to the recipient's scalp. Depending on the viscosity of such a thermoplastic material, some embodiments include a cover, container, bladder, film, bubble, skin or other structure 157 to contain the material when it is in a more viscous state, as is illustrated in FIG. 5.

Figure 5:
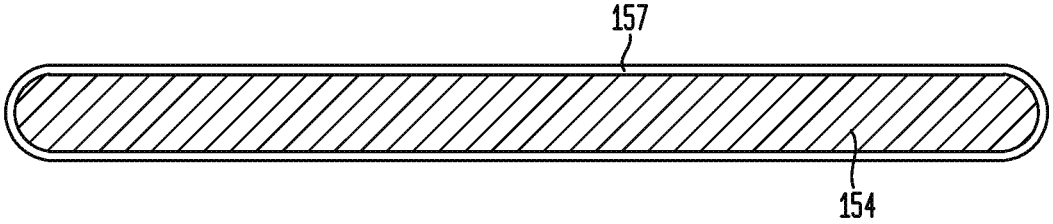
FIG. 5 is an enlarged side view, in section, of an embodiment of the pad having a cover or container.

In alternative embodiments, pad 154 includes other materials, for example, as filler for a pad structure that might include a bladder or other fluid-holding structure 157 (FIG. 5). Such materials include, for example, electro-rheological (ER) or magneto-rheological (MR) fluids. Electro-rheological fluids generally are suspensions of extremely fine non-conducting particles (up to 50 micrometres diameter) in an electrically insulating fluid. The apparent viscosity of these fluids changes reversibly by an order of up to 100,000 in response to an electric field.

A magneto-rheological fluid typically consists of 20-40 percent by volume of relatively pure, 3-10 micron diameter iron particles, suspended in a carrier liquid such as mineral oil, synthetic oil, water or glycol. When subjected to a magnetic field, the fluid greatly increases its apparent viscosity, to the point of becoming a viscoelastic solid.

Such ER and MR fluids could be controlled to have a lower viscosity while conforming to the recipient's anatomy and then controlled to have a higher viscosity when sound transmission is desired. Such higher apparent viscosity might be induced in the fluid only during detection of sound at a certain level so that pad 154 can re-conform to the recipient's anatomy during periods of relative silence. As with other pad 154 materials that exhibit low viscosity at least some of the time, ER and MR fluids may need to be contained in a cover, container, bladder, film, bubble, skin or other structure 157 as depicted in FIG. 5.

Pad 154 may also be a multi-layer structure having layers of different materials or of similar materials having different physical properties. For example, in one embodiment, pad 154 is a multi-layered structure comprising urethane foams. Pad 154 may also be coated with one or more of a variety of coatings chosen to impart one or more physical or aesthetic properties such as color, durability, impermeability or other properties.

Furthermore, the contact between the recipient and pressure plate 146 may have implications for sound quality, feedback and the like and can also have implications for the appearance of device 100.

As illustrated in FIG. 2, a pad 154 may be interposed between pressure plate 146 and the recipient's skin 132 in order to equalize pressure exerted on the skin. Pad 154 may include a material that generally conforms over time to the contour of the recipient's skin, thereby equalizing such pressure on the skin. In one embodiment, the material forming pad 154 may be soft enough to generally conform to topologies of at least a portion of the recipient's body or head at a recipient's body temperature. Pad 154 is formed of one or more materials selected so that the pad exhibits properties of a rigid body in response to audio-frequency vibrations. As such, embodiments of pad 154 thereby efficiently transmit such vibrations from pressure plate 142 to components 150 implanted in the recipient notwithstanding the conformational capabilities of the pad.

Referring to FIG. 3, pad 154 may be attached to pressure plate 146 with adhesive tape or film 158 positioned between pad 154 and pressure plate 146. Alternatively, pad 154 may be secured to pressure plate 146 by mechanical or any other means which appropriately facilitate (or at least does not unduly interfere with) transmission of vibrations between these two components.

Adhesive 166 may also be used if desired between pad 154 and recipient's skin or scalp 132 to augment the magnetic force holding external component 140 in place or to augment a secondary material such as a non-porous film that is easy to clean or, alternatively, an additional pad.

Figure 4:
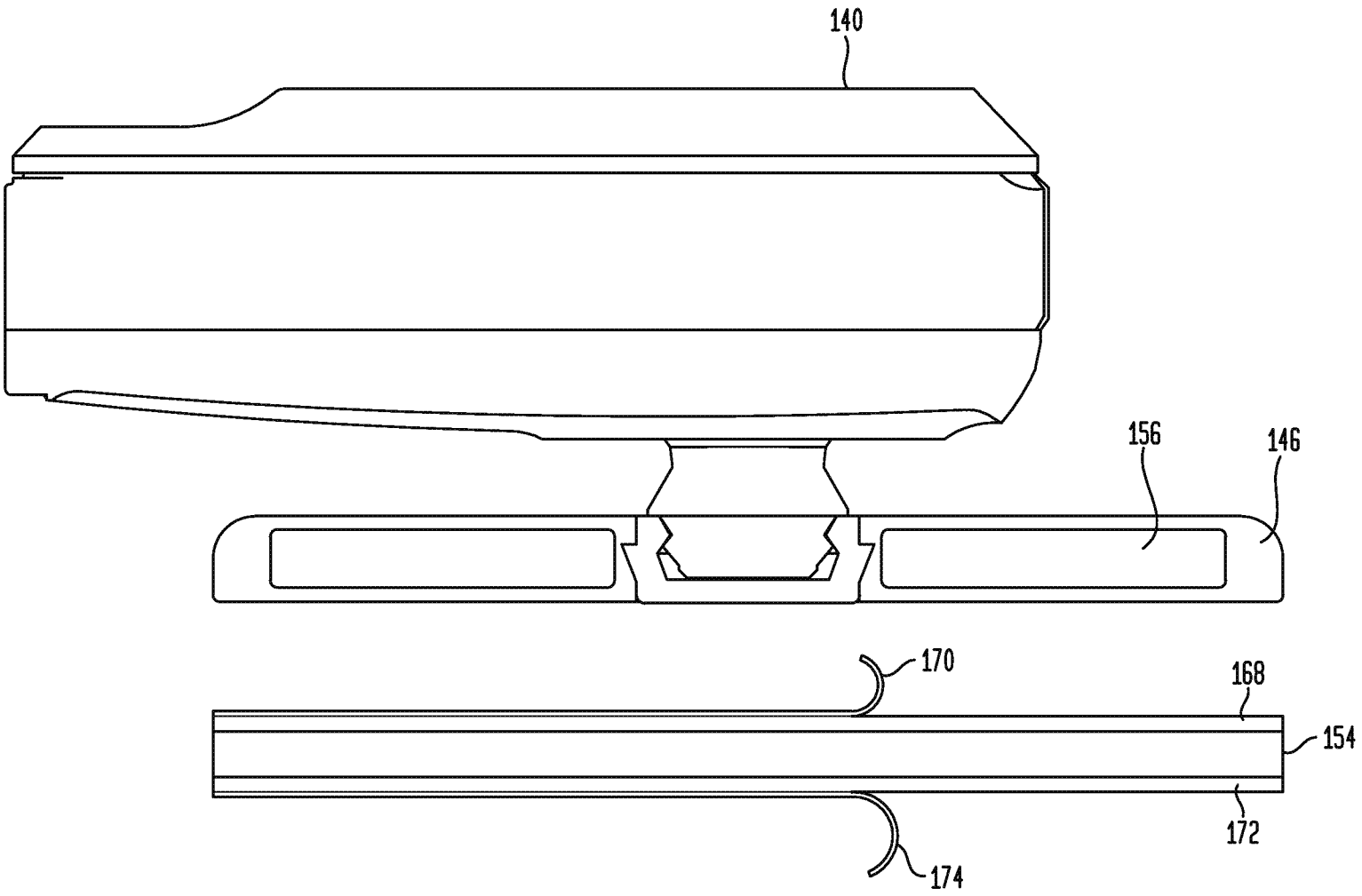
FIG. 4 is an enlarged side view of another embodiment of the bone conduction pad with adhesive and release films.

As is illustrated in FIG. 4, pad 154 can have an upper layer of adhesive 168 protected by a release film 170 that is removed before attaching pad 154 to pressure plate 146. Moreover, a lower layer of adhesive 172 suitable for recipient contact may be protected by a release film 174 that is removed before positioning external component 140 on the recipient's scalp or skin 132.

The appropriate shape and thickness of pad 154 will depend on the system with which it is being used, the shape and size of pressure plate 146, and numerous other considerations. Some such pads 154 may be approximately the same shape as pressure plate 146 with which the pad is used and may be approximately 0.5 to 5 millimeters thick, preferably about 1 to 2 millimeters thick, and more preferably about 1 millimeter thick.

While various embodiments of the present disclosure have been described above, it should be understood that they have been presented by way of example only, and not limitation. It will be apparent to persons skilled in the relevant art that various changes in form and detail can be made therein without departing from the spirit and scope of the teachings of this disclosure. Thus, the breadth and scope of the present disclosure should not be limited by any of the above-described exemplary embodiments, but should be defined only in accordance with the following claims and their equivalents.

Different arrangements of the components depicted in the drawings or described above, as well as components and steps not shown or described are possible. Similarly, some features and sub-combinations are useful and may be employed without reference to other features and sub-combinations. Embodiments have been described for illustrative and not restrictive purposes, and alternative embodiments will become apparent to readers of this patent. For example, transcutaneous bone conduction device 100 is, as noted, a passive device due to the vibrating actuator being located externally; that is, in external component 140. It should be appreciated, however, that aspects and embodiments disclosed herein may be implemented in an active transcutaneous bone conduction device which has the vibrating actuator located in an implantable or internal component such as internal component 150. Accordingly, the scope of the claims is not limited to the embodiments described above or depicted in the drawings, and various embodiments and modifications can be made without departing from the scope of the claims below and their equivalents.

What is claimed is:

1. A pad for interposition between a recipient's head and a transcutaneous bone conduction device pressure plate, the pad comprising a material providing a controllably variable balance of pressure-equalization and vibration-transmission capability, wherein the pad is a foam pad, the pad is compressible, and the pad is configured to increase in rigidity when exposed to vibrations at audio-frequencies, thereby enhancing the vibration transmissibility of the pad relative to that which was the case prior to the generation of the audio-frequency vibrations.

2. The pad of claim 1, wherein the material comprises non-Newtonian material having capacity to conform slowly to the contour of the recipient's head.

3. The pad of claim 1, wherein the material comprises non-Newtonian material having capacity to efficiently transmit audio frequency vibrations.

4. The pad of claim 1, wherein the material comprises dilatant material.

5. The pad of claim 1, wherein the material comprises rheopectic material, and wherein the rheopectic material comprises polymeric material.

6. The pad of claim 1, wherein the material comprises slow-recovery memory foam.

7. The pad of claim 1, wherein the material exhibits a viscosity of between approximately 100 and $1\times10^{10}$ centipoise.

8. A transcutaneous bone conduction system comprising:
an external component; and
a conformable pad for positioning between a recipient's scalp and the external component,
wherein
the pad is a foam pad,
the pad is compressible, and
the pad is configured to increase in rigidity when exposed to vibrations at audio-frequencies, thereby enhancing the vibration transmissibility of the pad relative to that which was the case prior to the generation of the audio-frequency vibrations.

9. The system of claim 8, wherein the pad comprises a non-Newtonian material that comprises a dilatant material.

10. The system of claim 8, wherein the pad comprises a non-Newtonian material that comprises a memory foam.

11. A method, comprising:
causing the viscosity of a material to decrease thereby enabling a pad containing the material to conform to the topographies of a recipient's head; and
causing the viscosity of the material to increase thereby enabling the pad to effectively transfer sound vibrations to the recipient's head, wherein
the material is part of a bone conduction device,
the action of conforming to the topographies of a recipient's head is executed with the material at a first viscosity while the bone conduction device is held against the recipient's head, and
the method further comprises effectively transferring sound vibrations to the recipient's head while the bone conduction device is held against the recipient's head while the material is at a second viscosity higher than the first viscosity, which second viscosity enables the pad to effectively transfer the sound vibrations to the recipient's head.

12. The pad of claim 1, wherein the pad is configured to maintain a substantially uniform thickness when applied against the recipient's head.

13. The pad of claim 1, wherein the material is configured to be controllably placed into at least a partially solid state from a previously non-solid state, thereby controllably variably balancing pressure-equalization and vibration-transmission capability.

14. The method of claim 11, further comprising the action of transmitting a vibration through the material after the viscosity thereof has been caused to increased, thereby evoking a bone-conduction hearing percept.

15. The system of claim 8, wherein the pad comprises a non-Newtonian material that is configured to transfer low frequency vibrations from the external component to the recipient's scalp to evoke a bone conduction hearing percept.

16. The system of claim 8, wherein the pad exhibits properties of a rigid body in response to audio-frequency vibrations not present in the absence of such.

17. A method, comprising:
placing an external component of a bone conduction device against skin of a recipient such that a retention force is established that holds the external component to the skin of the recipient; and
compressing, owing to the retention force holding the external component to the skin of the recipient, a foam pad that is interposed between skin of the recipient and a vibrator of the bone conduction device, wherein at least one of:
(i) the method further includes the action of increasing a hardness of the pad by activating the vibrator to generate audio-frequency vibrations, thereby enhancing the vibration transmissibility of the pad relative to that which was the case prior to the generation of the audio-frequency vibrations; or
(ii) the compression of the pad increases hardness of the pad relative to that which was the case prior to the compression.

18. The method of claim 17, wherein:
the method further includes the action of increasing the hardness of the pad by activating the vibrator to generate audio-frequency vibrations, thereby enhancing the vibration transmissibility of the pad relative to that which was the case prior to the generation of the audio-frequency vibrations.

19. The method of claim 18, further comprising:
halting the generation of the vibrations, thereby decreasing the hardness of the pad.

20. The system of claim 8, wherein the material comprises polymeric material.

21. The method of claim 14, wherein the material comprises a rheopectic material that is a polymeric material.

22. The method of claim 17, wherein:
the compression of the pad increases hardness of the pad relative to that which was the case prior to the compression.

23. The method of claim 17, wherein:
the compression of the pad increases hardness of the pad relative to that which was the case prior to the compression, and transfer of thermal energy to or from the pad does not influence the hardness of the pad.

24. A bone conduction device, comprising:
a self-contained external component including a pressure plate including a magnet, and a vibrating actuator; and
a pad for interposition between a recipient's head and a transcutaneous bone conduction device pressure plate, the pad comprising a material providing a controllably variable balance of pressure-equalization and vibration-transmission capability, wherein
the magnet is configured to entirely support the self-contained external component against the recipient's head, and
the material is configured to be controllably placed into at least a partially solid state from a previously non-solid state, thereby controllably variably balancing pressure-equalization and vibration-transmission capability.

25. A bone conduction device, comprising:
a self-contained external component including a pressure plate including a magnet, and a vibrating actuator; and
the pad of claim 1.

26. The method of claim 17, wherein the external component is a self-contained external component, wherein the method further includes transmitting a vibration through the material after the hardness thereof has been caused to increase while the external component is held against the skin of the recipient.

27. A bone conduction device, comprising:
an external component including a vibrating actuator; and
the pad of claim 1, wherein
the bone conduction device is configured such that all vibrations generated by the vibrating actuator that travel a path that is part of the bone conduction device to the recipient's head travel through the pad.

28. A bone conduction device, comprising:
a self-contained external component including a transcutaneous bone conduction device pressure plate including a magnet; and a pad for interposition between a recipient's head and the pressure plate, the pad comprising a material providing a controllably variable balance of pressure-equalization and vibration-transmission capability, wherein an outer circumference of the pad is the same as the outer circumference of the pressure plate, wherein the magnet is configured to entirely support the self-contained external component against the recipient's head.

29. The method of claim 11, wherein:

the change from the first viscosity to the second viscosity occurs due to a presence of sound at a certain level.

30. The pad of claim 1, wherein the material comprises non-Newtonian material having capacity to conform quickly to the contour of the recipient's head.

31. The bone conduction device of claim 28, wherein the pad is a memory foam.

32. The bone conduction device of claim 28, wherein transfer of thermal energy to or from the pad does not influence the hardness of the pad.

33. The pad of claim 1, wherein the pad is a multi-layered structure comprising urethane foam.

34. The method of claim 24, wherein an outer circumference of the pad is the same as the outer circumference of the pressure plate.

35. The system of claim 28, wherein:

the external component includes a vibrating actuator; and the bone conduction system is configured such that all vibrations generated by the vibrating actuator that travel a path that is part of the bone conduction device to the recipient's scalp travel through the pad.

36. The system of claim 8, wherein:

the eternal component includes a vibrator, wherein the system is positioned such that the conformable pad is positioned against the recipient's scalp and the external component is positioned on the opposite side of the pad from the recipient's scalp.

37. The system of claim 8, wherein:

the system includes a pressure plate, and the pad distributes forces exerted by the pressure plate substantially evenly across an entire area of contact between the pad and the recipient's scalp.

38. The bone conduction device of claim 28, wherein:

the pad is configured to increase in stiffness when exposed to vibrations at audio-frequencies, thereby enhancing the vibration transmissibility of the pad relative to that which was the case prior to the generation of the audio-frequency vibration.

39. The bone conduction device of claim 38, wherein:

the pad is a foam pad.

40. A bone conduction device of claim 24, wherein:

the pad is configured to increase in stiffness in the presence of a shear force thereby enhancing vibration transmissibility of the pad relative to that which was the case prior to the application of the shear force.

41. The bone conduction device of claim 24, wherein:

the pad is configured to increase in stiffness when exposed to vibrations at audio-frequencies, thereby enhancing the vibration transmissibility of the pad relative to that which was the case prior to the generation of the audio-frequency vibration.

42. The bone conduction device of claim 41, wherein:

the pad is a foam pad.

43. A bone conduction device of claim 28, wherein:

the pad is configured to increase in stiffness in the presence of a shear force thereby enhancing vibration transmissibility of the pad relative to that which was the case prior to the application of the shear force.

* * * * *